United States Patent [19]

Ahern

[11] Patent Number: 5,040,336

[45] Date of Patent: Aug. 20, 1991

[54] NON-CONTACT POLISHING

[75] Inventor: Brian S. Ahern, Boxboro, Mass.

[73] Assignee: The United States of America as represented by the Secretary of the Air Force, Washington, D.C.

[21] Appl. No.: 818,944

[22] Filed: Jan. 15, 1986

[51] Int. Cl.[5] ..... B24B 31/06

[52] U.S. Cl. ..... 51/7; 51/283 R; 51/277; 51/317

[58] Field of Search ..... 51/3, 4, 317, 7, 16, 51/17, 131.2, 283, 277

[56] References Cited

U.S. PATENT DOCUMENTS

| | | | |
|---|---|---|---|
| 1,963,563 | 6/1934 | Slepicka | 51/17 |
| 2,591,083 | 4/1952 | Maier | 51/317 |
| 3,061,422 | 10/1962 | Sato | 51/310 |
| 3,523,834 | 8/1970 | Hewins | 51/317 |
| 3,813,816 | 6/1974 | Funk | 51/7 |
| 4,270,316 | 6/1981 | Kramer et al. | 51/283 R |
| 4,519,168 | 5/1985 | Cesna | 51/283 R |

FOREIGN PATENT DOCUMENTS

| | | | |
|---|---|---|---|
| 0041664 | 4/1979 | Japan | 51/317 |
| 0145604 | 8/1983 | Japan | 51/317 |
| 0541647 | 3/1977 | U.S.S.R. | 51/317 |

OTHER PUBLICATIONS

Swain, M. V. et al., "Further Studies on Environment-Sensitive Hardness and Machinability of $Al_2O_3$, " *Journal of The American Ceramic Society*, vol. 58, No. 9-10, 1975, pp. 372-376.

Brinton, J. B.; "Spinning Etchant Polishes Flat, Fast", Electronics; vol. 55, No. 1, Jan. 13, 1982.

*Primary Examiner*—Robert A. Rose

*Attorney, Agent, or Firm*—Stanton E. Collier; Donald J. Singer

[57] ABSTRACT

A non-contact polishing apparatus is used for polishing semiconductor planar substances. The substrate is set back from any surface and is held by a chuck fixed within a collar. This substrate holder assembly is placed within an enclosed container that has a non-abrasive solution therein. The container is mounted to a high speed nutating table that provides random motion to the holder assembly. This action provides isotropic polishing with no polishing created defects on the substrate surface.

2 Claims, 1 Drawing Sheet

NON-CONTACT POLISHING

STATEMENT OF GOVERNMENT INTEREST

The invention described herein may be manufactured and used by or for the Government for governmental purposes without the payment of any royalty thereon.

BACKGROUND OF THE INVENTION

The present invention relates to the polishing of semiconductor substrates and, more particularly, to the polishing of planar surfaces of silicon, for example.

Semiconductor devices such as integrated monolithic circuits, diodes, passive devices and the like, are formed by various techniques such as diffusion and epitaxial growth, in the planar surfaces of semiconductor substrates For such semiconductor device fabrication, polished silicon wafers, free of undesirable crystal defects and surface imperfections is a basic requirement. Polishing and cleaning of the wafers is normally the last process in the preparation of the wafers for device fabrication.

Although the requirement for a high degree of polishing has heretofore existed in the semiconductor art, the higher levels of microminiaturization of device size, the perfection of surface quality of the polished wafer has become of paramount importance in regard to the feature of surface fine-structure conditions down to an order of Angstrom units, planarity, uniformity and freedom of surface irregularities and crystal damage.

A substantial portion of commercially available silicon wafers are polished with compositions comprised of silicon dioxide having particle sizes in the colloidal range of 1–500 mμ (millimicrons) with particles suitable for polishing ranging in size from 10–150 mμ. Properly sized silicon dioxide compositions with nominal particle sizes of 16 mμ are commercially available, normally in the form of sols and gels.

Virtually any type of polishing cloth, such as synthetic leather, resin non-woven types, can be used with such a silicon dioxide polishing composition, typical of which are Corofam and Blue Rodell. Polishing may be effected in machines such as described in Geotz et al, U.S. Pat. No. 3,691,694 including modification thereof.

During polishing, wheel speeds may vary from 40 to 200 rpm applied at pressures of 2–6 psi. The slurry feed (e.g., $SiO_2$ polishing composition) is usually continuous at a flow rate of not less than 10 cc per minute and the slurry may be recirculated. The rate of stock removal, from the silicon wafers, is approximately 0.75 mils per hour.

Although the foregoing produces polished wafers having a high and acceptable degree of perfection, the process is nevertheless relatively slow with considerable time required to attain such a degree of perfection. Attempts to accelerate such polishing, as by increasing pressures or nature of abrasives (e.g., size and/or hardness) can result in sub-surface damage which becomes evident in subsequent device fabrication.

SUMMARY OF THE INVENTION

The present invention sets forth a non-contact polishing apparatus and thereby overcomes the problems noted hereinabove The present invention polishes semiconductor substrates, for example, silicon wafers, by the action of a polishing solution thereon which has no abrasive materials therein such as conventional silicon diode.

The non-contact polishing apparatus comprises a nutating table having a liquid container mounted thereon. The liquid container has separable halves being a cover and a receptable. These are held together with a liquid seal therebetween to prevent leakage of corrosive chemicals therefrom as a result of the vibrating motion of the container. The receptacle has input and output ports thereon so that polishing solution can be input as well as removed by dilution and/or neutralization.

A substrate holder assembly is placed inside the liquid container. The substrate holder has a cylindrical collar with a cylindrical substrate chuck mounted therein. The substrate chuck is vertically adjustable within the collar so that a desired setback can be selected. The collar also has a rubber bumper circumferentially mounted thereon to prevent any unnecessary jarring of the holder within the liquid container as the table nutates.

The bottom of the collar has a plurality of openings therethrough to allow the passage of liquid and reduce friction on the receptacle bottom. Or, the bottom surface can be configured to allow the passage of liquid and also reduces any hydrostatic and/or hydrokenetic drag on the bottom of the receptacle.

One object of the present invention is to provide a non-contact polishing process.

Another object of the present invention is to provide for a non-contact polishing apparatus using a nutating table;

Another object of the present invention is to provide for a non-contact polishing process that eliminates the need for any lapping;

Another object of the present invention is to provide for a non-contact polishing apparatus that is totally sealed to prevent leakage.

These and many other objects and advantages of the present invention will be readily apparent to one skilled in the pertinent art from the following detailed description of a preferred embodiment of the invention and the related drawings.

DETAILED DESCRIPTION OF THE PREFERRED EMBODIMENT

Figure 1:
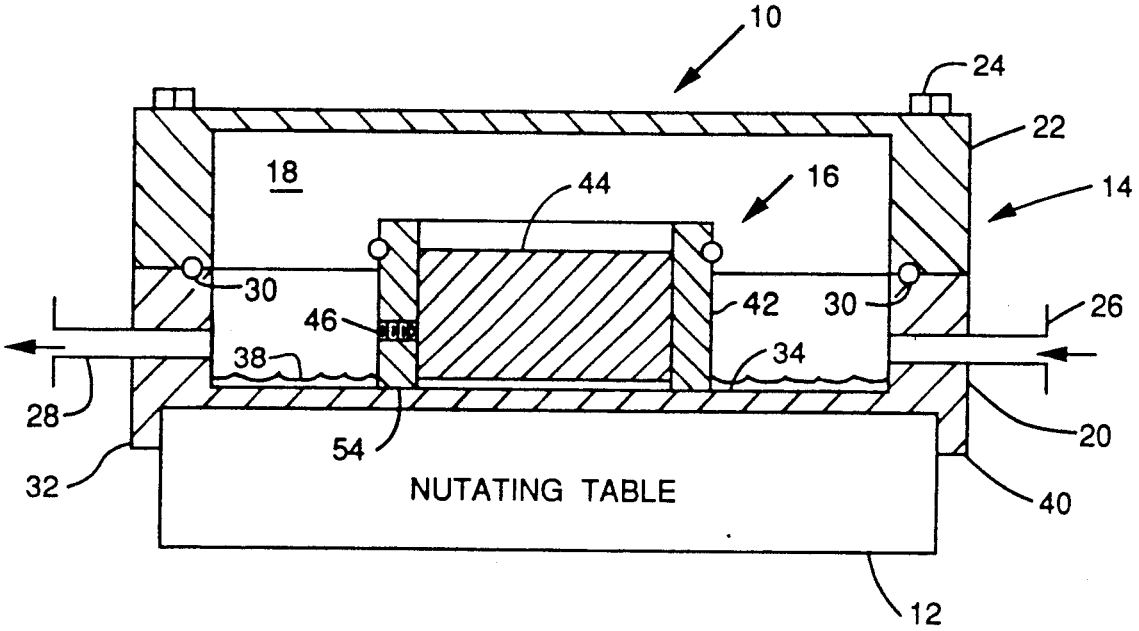
FIG. 1 illustrates by cross-section one liquid container with a substrate holder herein.

Referring to FIG. 1, a non-contact polishing apparatus 10 is shown in cross-section. Non-contact polishing apparatus 10 has a motive means such as a nutating table 12 and a liquid container 14 mounted upon nutating table 12. A substrate holder assembly 16 is placed within an interior space 18 of liquid container 14.

Liquid container 14 has the following parts: a receptacle 20, a cover 22, securing means 24, an input port 26, an output port 28, an o-ring 30 for sealing cover 22 to receptacle 20, and attachment means 32. Receptacle 20, cover 22 and ports 26 and 28 are made of material resistant to chemical attack. It has been found in the past that high density polyvinyl chloride (PVC) has proven to be highly resistant to both chemical attack and wear. Receptacle 20 has a flat bottom 34 which should not impede the movement of substrate holder assembly 16. A high degree of flatness is not critical since there is no contact between bottom 34 and a semiconductor substrate 36 shown in FIG. 2.

A polishing solution 38 is input through port 26. A suitable polishing solution 38 for GaAs, InP, etc. semiconductor substrate 36 is a mixture of bromine and methanol. Other combinations of solutions 38 are clearly possible. After the polishing is completed deionized water, for example, is input through port 26 to dilute solution 38. The diluted solution 38 is forced out of port 28 to a suitable container, not shown. Any level of solution 38 in liquid container 34 is allowed since cover 22 and receptacle 20 are sealed together by bolts, for example. A flange 40 may be suitable as attachment means 32 to hold container 14 securely to table 12 while polishing. But brackets with bolts can also be used to hold receptacle 20 to table 12.

Figure 2:
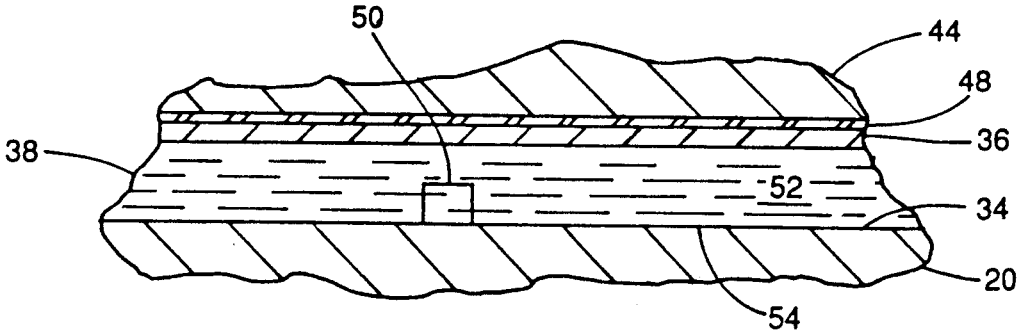
FIG. 2 illustrates by cross-section the means of holding a semiconductor substrate to a chuck.

Substrate holder assembly 16 has a cylindrical tubular collar 42 with a cylindrical chuck 44 that is adjustable in the vertical direction within collar 42 and is held fixedly within by a set screw 46, for example. Referring to FIG. 2, semiconductor substrate 36 is attached to substrate chuck 44 with a suitable adhesive 48 such as thermo-setting glue. FIG. 2 further illustrates fluid openings 50 in collar 42 so that solution 38 may freely flow into an active polishing volume 52. The bottom surface 54 of collar 44 may have grooves therein, or other configurations, to lower friction between collar 44 and bottom 34 of receptacle 20. A layer of material may be placed on bottom 34 to serve as a friction reducer.

In operation substrate chuck 44 is vertically adjusted in collar 42 so that there is a desired clearance between substrate 36 and container 14. Polishing solution 38 fills the active polishing volume 52. As nutating table 12 moves, collar 42 with substrate chuck 44 therein moves about container 14. The action of solution 38 in combination with the movement of table 12 causes a uniform polishing action of substrate 36 without physically contacting another surface.

Table 12 imparts random motion to assembly 16 and thus prevents dissolution along a preferred direction and thus the finished product is isotropic.

Another feature is the ability to clean substrate 36 while it is encased in container 14.

Clearly, many modifications and variations of the present invention are possible in light of the above teachings and it is therefore understood, that within the inventive scope of the inventive concept, the invention may be practiced otherwise than specifically claimed.

What is claimed is:

1. A non-contact polishing apparatus for polishing a semiconductor substrate, said apparatus comprising:

a means for imparting random motions to said semiconductor substrate;

a means for containing a polishing liquid, said means for containing fixedly mounted to said means for imparting, said means for containing being a receptacle having a substantially flat bottom, a wall thereabout and a cover thereon, said polishing liquid resting within said means for containing, said cover and said receptable having a liquid seal therebetween to prevent the leakage of said polishing liquid therefrom, said means for containing having fluid input and output ports therein to allow movement of fluid without removing said cover; and means for adjustably holding a semiconductor substrate in a substantially parallel position with respect to said flat bottom, said semiconductor substrate being set back from said flat bottom a preselected distance to be in non-contact therewith.

2. A non-contact polishing apparatus as defined in claim 1 wherein said means for adjustably holding comprises at least one substrate holder assembly having:

a collar, said collar being in sliding contact with said flat bottom;

a substrate chuck adjustably held within said collar; and means for holding said substrate chuck within said collar, said semiconductor substrate being removably attached to said substrate chuck with an adhesive.

* * * * *